United States Patent [19]

Greer

[11] 4,299,280

[45] Nov. 10, 1981

[54] TOOL RETAINING APPARATUS

[76] Inventor: Cecil B. Greer, 1915 Willis Dr., Longview, Tex. 75601

[21] Appl. No.: 137,384

[22] Filed: Apr. 4, 1980

[51] Int. Cl.[3] ..... E21B 23/04; E21B 41/00

[52] U.S. Cl. ..... 166/75 R; 166/113

[58] Field of Search ..... 166/75 R, 77, 70, 81, 166/83, 243, 175

[56] References Cited

U.S. PATENT DOCUMENTS

| | | | |
|---|---|---|---|
| 1,669,655 | 5/1928 | Cormier | 166/70 |
| 1,809,175 | 6/1931 | Loomis | 166/75 UX |
| 2,375,432 | 5/1945 | Miller et al. | 166/75 UX |
| 2,710,064 | 6/1955 | Osmun | 166/70 |
| 2,941,598 | 6/1960 | Jackson | 166/77 |
| 3,152,645 | 10/1964 | Abbott | 166/304 X |
| 3,435,895 | 4/1969 | Lee | 166/75 |

*Primary Examiner*—Stephen J. Novosad
*Attorney, Agent, or Firm*—Gunn, Lee & Jackson

[57] ABSTRACT

In the preferred and illustrated embodiment found in the drawings herein, tool retaining apparatus is disclosed. It is a catch mechanism for catching and securing wireline tools. It incorporates an elongate tubular body to be attached at the well head and works above a producing well. It is axially hollow to pass a wireline supporting a down hole tool. The elongate tubular body surrounds a sleeve positioned within it. The sleeve has a shoulder around its exterior to define upper and lower pressure receiving chambers, thereby enabling external pressure to be applied to drive the sleeve up or down. The sleeve supports a pair of opposing pivotally mounted flaps at the top end. The flaps have laterally projecting tabs which are positioned in cavities to enable the flaps to extend toward one another. They are supported on a shoulder to maintain a catch position. Because they are pivotally mounted, a wireline supported down hole tool can be retrieved upwardly through or past the flaps. The flaps, however, extend across the center and are positioned adjacent to one another. They bottom support the tool once it is above the flaps. The flaps can selectively be retracted to a withdrawn position.

6 Claims, 5 Drawing Figures

TOOL RETAINING APPARATUS

BACKGROUND OF THE DISCLOSURE

This disclosure is directed to a wireline tool catch mechanism. In a completed oil well, periodic servicing of the well is required. This is normally accomplished by installing certain equipment at the well head. The equipment will typically include equipment for enabling the wireline to enter into the well. This is accomplished by usually installing at the well head a blowout preventer. A lubricator is also installed. A wireline is extended through all of the equipment and support some kind of down hole tool. The tool typically has the form and shape of an elongate cylindrical body of specified length.

The present invention is a trap apparatus to be installed in conjunction with the blowout preventer and lubricator to catch and hold the down hole equipment supported on the wireline. As the wireline tool is retrieved, it is important to get it above the trap so that the trap can operate, thereby closing the passage and preventing dropping of the tool. The tool is, therefore, caught above the trap. Above the trap, it is safe against accidental loss.

One prior art device is depicted in U.S. Pat. No. 3,435,895. This apparatus utilizes a single gate which pivots at one side of the passage and rotates into a tool catching position. A single gate is formed in the shape of a bifurcated spade having a deep slot cut through the middle. Moreover, there is a large side pocket on the body to enable the single gate to fold to the side. Manufacturing costs are inevitably increased because this construction is not made from tubular stock and is difficult to machine in contrast with tubular goods.

The present invention is readily contrasted with the referenced patent in that it utilizes a pair of opposing pivotally mounted gates which function opposite one another. They function together to fully close the passage. Moreover, they are formed of cooperating semicircular components. On retraction, they are sufficiently small and shaped such that the entire apparatus can be fabricated from tubular stock and does not require an odd shaped casting.

Another advantage which the present apparatus has is found in an external indicator of its position. The position indicator comprises a side located indicator pin which inevitably forms an indication of whether or not the twin gates are down or up. Through the use of color coding and the like, this is extremely helpful to determine the operative state of the trap device of the present invention. Another important advance found in this apparatus is the utilization of a pair of opposing pivotally mounted gate pieces. They are identical in construction to one another. When both are down, they completely block across the passage. They come close to contacting one another, not closing with a very narrow slot left between them.

The present invention is improved in the aforementioned features over the cited prior art. These features and others will be noted on considering the mode of operation of this equipment. It is primarily an elongate tubular body adapted to be installed above a blowout preventer in conjunction with a lubricator above a producing well. The elongate tubular body terminates in a lower coupling for ease of connection. It incorporates a pair of tubular members threaded together at the central portions which enlarge the body to receive an internally located sleeve which moves upwardly and downwardly. The sleeve is driven by hydraulic power through fluid introduced on the exterior above or below an encircling ring or shoulder. The shoulder is positioned between a pair of hydraulic ports to define upper and lower hydraulic chambers. The sleeve is moved upwardly or downwardly as specified. The sleeve supports a pair of opposed pivot mounts for a pair of gates. They are constructed identically to one another and are deployed on opposite side of the sleeve. The gates have a protruding tab. The tab extends beyond the sleeve. When opposite a cavity, the tabs are provided with room to enable them to pivot to a horizontal posture, thereby enabling the two gates to be positioned on a common plane transverse to the axial passage for closing the passage. They rotate downwardly into the horizontal position and rest on a transverse shoulder. In this position, they are able to support a wireline tool on the top face. The two gates cooperate to support the tool. By contrast, they pivot up and retract to a position against the side wall of the surrounding sleeve or tubular body. In the retracted position, the axial passage is cleared to enable the wireline line supported tube to drop past the gates.

The equipment further includes means forming an external indication of the position of the gates. When they are in the retracted position, the tool is open to free axial movement of the wireline tool. The indicator includes a spring loaded indicator rod which extends to the side and which can be observed to determine the position of the sleeve. This, in turn, indicates the operative state of the gates.

THE DRAWINGS

DETAILED DESCRIPTION OF THE PREFERRED EMBODIMENT

Figure 1:
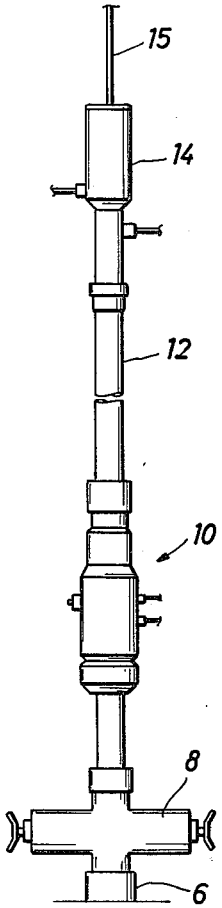
FIG. 1 is an installation of equipment located above at the well head of a producing well to enable a wireline tool to be run into the well wherein the tool of the present invention is installed with the cooperative equipment shown in FIG. 1.

Attention is first directed to FIG. 1 of the drawings. In FIG. 1 of the drawings, the stacked equipment which is associated with a producing well is illustrated. This equipment utilizes the present invention but it also depicts certain support equipment or apparatus. Assume, therefore, that there is a producing well which has some significant internal pressure. Assume further that workover is required to service or maintain the well. The well includes a well head at the surface of the ground identified by the numeral 6. The equipment located above the well head includes a blowout preventer 8. The blowout preventer 8 is a bought item which is installed in the equipment as a safety device. It closes when the well achieves runaway flow. The blowout preventer 8 is located immediately below the wireline tool trap 10 of this disclosure. They are connected serially with an open passage extending from the well through the wireline trap. The equipment further utilizes a lubricator 12. The lubricator 12 is installed above the wireline tool trap 10. A control head 14 is affixed to the top of the lubricator. The numeral 15 identifies a wireline which extends from above the equipment to a down hole supported oil tool. The nature of the tool itself is not critical; it is typically an elongate cylindrical body supported on the wireline 15.

The equipment shown in FIG. 1 enables the wireline supported tool to operate without leakage. Even though the well may have a relatively high ambient pressure, the lubricator and control head cooperate to prevent leakage along the wireline. They function somewhat as a packing gland or stuffing box. To this end, the wireline passes through an eyelet or constriction and extends into the well, leakage along the wireline being prevented by packing the crevices and interstices of the woven wireline.

Figure 2:
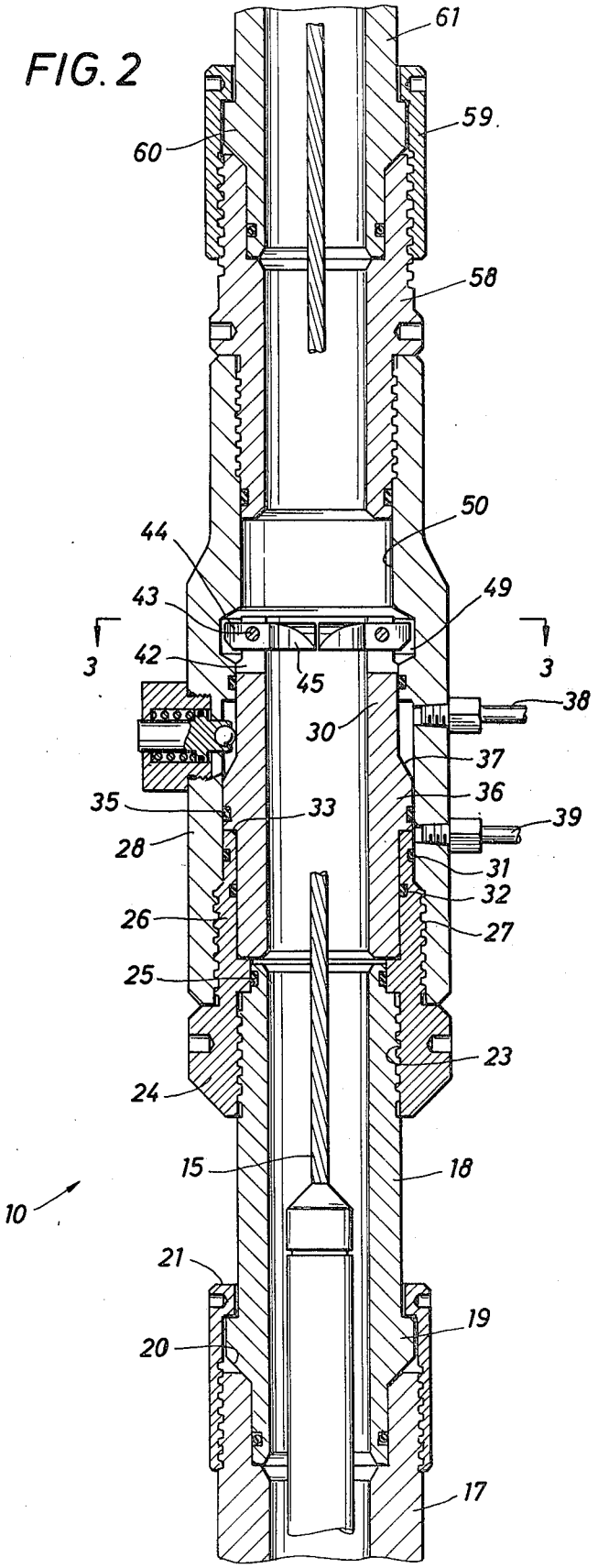
FIG. 2 is a sectional view through the length of the tool of the present invention including a wireline and supported tool therein.

Attention is next directed to FIG. 2 of the drawings where the wireline tool trap is shown in detail. The description will proceed from the lower end of the apparatus. The numeral 17 identifies a tubular member associated with the blowout preventer. The tubular member 17 telescopes on the exterior of a connective pipe 18. The connective pipe 18 has an enlargement 19 in the form of an encircling shoulder, the shoulder having a tapered face 20 on the lower side to nest against the surrounding telescoped structure. Moreover, the shoulder 19 supports a telescoped coupling member 21. Coupling member 21 has a set of internal threads which thread with mating threads therebelow to pull the shoulder 19 down snugly against the mating surface. This is accomplished to make a leak proof connection and to obtain structural integrity on joinder of the device to the blowout preventer. The coupling 21 is a loose sleeve which cannot pass over the shoulder 19 and lodges against it when the threads are made fast.

The connective pipe 18 is threaded at 23. This enables connection to an enlarged sub 24. The sub 24 threads against the upper end of the pipe 18 and makes a leak proof connection with it. Leakage along the threads 23 is prevented by a seal member 25. The sub 24 is on the exterior. It, in turn, has an upstanding skirt 26 which is threaded at 27. The threads 27 join to a cylindrical housing 28 positioned on the exterior. The cylindrical housing 28 is larger in diameter than the pipe 18. The cylindrical housing is sufficiently large to receive a moveable sleeve 30 on the interior. The sleeve 30 can move upwardly and downwardly as shown in contrasting FIGS. 2 and 4.

The housing 28 threads to the skirt 26 at the threads 27, and leakage along these threads is prevented by a number of seals. A seal 31 is located between the sub 24 and the housing 28. A seal 32 is located between the telescoping sleeve 30 and the sub 24. The sleeve 30 is constructed with an enlargement on it having the form of an externally located encircling ring like member. It terminates at a transverse shoulder at the lower end, this shoulder mating with and abutting against the top end of the skirt 26. The enlargement includes the transverse shoulder 33 which is on the lower face of the enlargement 36. The upper shoulder is identified by the numeral 37.

The enlargement 36 is sized to define within the cylindrical housing 28 upper and lower hydraulic fluid receiving chambers. The fluid receiving chambers are isolated from one another by means of a seal 35. The seal 35, in conjunction with the enlargement 36, defines the two chambers. The upper chamber is filled with hydraulic fluid through a line 38 while the lower chamber is filled through a line 39. The lines 38 and 39 connect with a suitable hydraulic source which delivers oil under pressure. The two chambers are isolated from one another by the intervening seal so that pressurization of hydraulic oil in one chamber forces the ring and sleeve in one direction, and hydraulic fluid in the remaining chamber is forced from it. The hydraulic system is double acting in that the sleeve can be driven upwardly or downwardly, this being understood in contrasting FIGS. 2 and 4.

The cylindrical housing functions as a cylinder which receives the sleeve in it which moves in the fashion of a piston. It is not a fully closed piston because the sleeve is axially hollow. To this end, FIG. 2 shows the wireline 15 extending through the equipment and supporting some kind of down hole tool on it. The wireline extends through the sleeve 30 and passes fully through the tool 10. In the area of the sleeve 30, there is more than ample clearance for the wireline and tool. Indeed, FIG. 2 shows a uniform cross-sectional clearance for movement of the wireline and tool supported on it.

Figure 3:
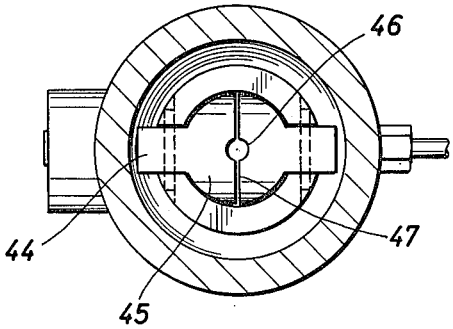
FIG. 3 is a sectional view along the line 3—3 of FIG. 2 showing details of construction of the gates which support and hold the wireline supported tool.

The sleeve 30 is constructed with upstanding tabs on opposite sides. Description of the tab on one side will suffice because it is identical to the tab on the other side. There are two tabs, and they encircle part of the top end of the sleeve and terminate at fairly deep notches. The numeral 42 identifies one of the notches which is cut in the top end of the sleeve. This defines a pair of opposing faces, and the faces are joined together by a transversely mounted pin 43. The pin 43 is a pivot or hinge pin. The pin 43 passes through a protruding tab 44 on a gate 45. The gate 45 is better shown in FIG. 3 of the drawings. There, the protruding tab 44 is illustrated extending laterally from a semi-circular plate which comprises a significant portion of the gate 45. The gate 45 is semi-circular in profile. It terminates at a diameter to cooperate and thereby fit immediately adjacent to an identical gate. The two gates have a gap between them. This gap is sufficient to permit them to pivot upwardly without interference contact as will be understood on viewing FIG. 2. Moreover, the two gates are identical in that they have radially protruding tabs to enable them to be pivotally mounted on opposite sides of the sleeve 30. The two gates are otherwise identical except that they are positioned in opposite fashion. As will be observed, they pivot along parallel axes to enable them to rotate upwardly.

The two gates substantially close the transverse passage through the wireline tool trap 10. They are slightly notched at the center at 46. The notch 46, in conjunction with the gap or slot 47 between the two gates, defines room for the wireline cable 15. It will be understood that the wireline cable may differ from day to day depending on the nature of the tool that is run in the well. The wireline may be relatively large or small depending on weight and further depending on the number of electrical conductors extending up through the wireline. In some instances, the wireline more nearly resembles piano wire which is often called slick line. In other instances, it may be a multistranded woven cable with a number of electrical conductors and suitable shielded insulators. Whatever the circumstance, the wireline size is accommodated at the gates in the slot 47 and the notch 46. The slot 47 thus serves two purposes; the slot, first of all, enables sufficient spacing between the gates so they may pivot past one another without banging together. In addition, the slot spacing, in part, determines the permissable diameter of the wireline. In the illustrated structure, the notch 46 enlarges slightly the gap between the two gates so that a larger wireline can be used. As a practical matter, the gap and notch dimensions can be varied even to the extent that the notch basically disappears. It is helpful that the notch approach semicircular construction; it is not essential that it be semicircular inasmuch as the gap between the gates may very well approximate the diameter of the wireline cable.

The gates as described to this juncture jointly support the tool in the event the tool is above the gates. The two gates together define a transverse service which almost closes the passage through the wireline tool trap 10. The gates are supported on a transverse shoulder 48 better shown in FIG. 4 of the drawings when they are in the transverse position. The notches 42 thus extend upwardly to the shoulder 48 which defines the upper terminus of the sleeve 30.

The surrounding cylindrical housing has a ring like internal cavity formed at 49 shown in FIG. 2 to receive the protruding tabs. This enables the two gates to pivot in the manner shown in FIG. 2. There, they are shown to close the passage to enable a tool to be supported thereon. This is the catch position for the gates. There is another position as will be described. The cavity 49 is an internally cut cylindrical cavity. This cavity provides clearance for the protruding tabs 44. They are free to extend into the cavity in the closed position illustrated in FIG. 2.

Figure 4:
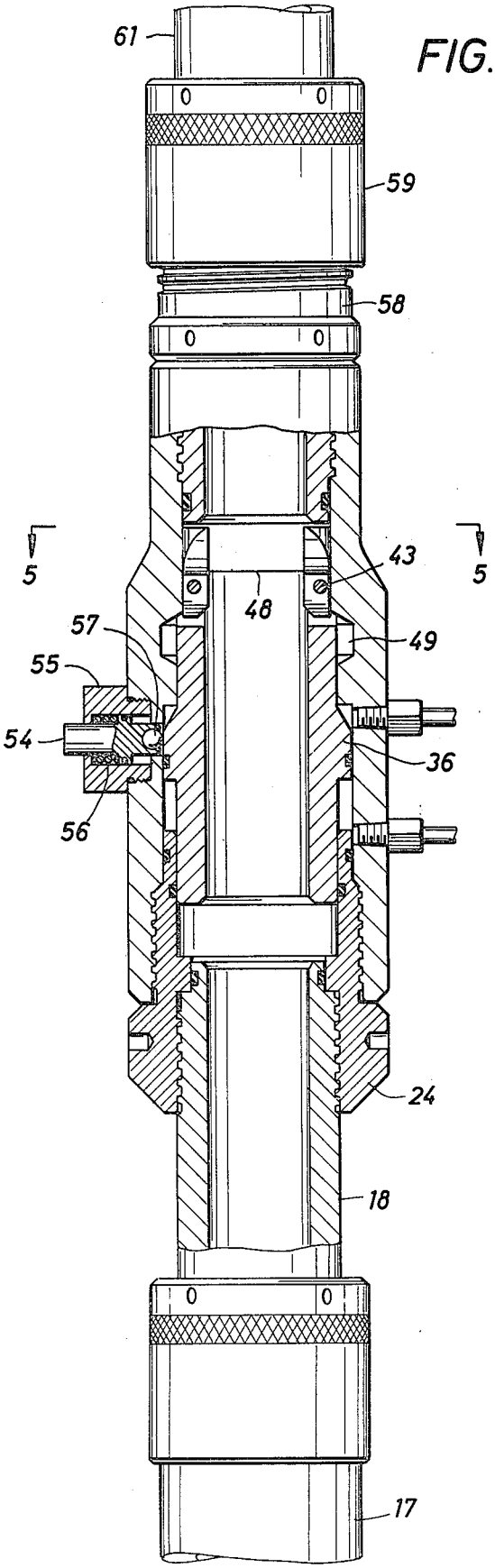
FIG. 4 is a view similar to FIG. 2 showing operation of the gates therein achieved on hydraulic operation of the sleeve to the raised position in contrast with FIG. 2.
Figure 5:
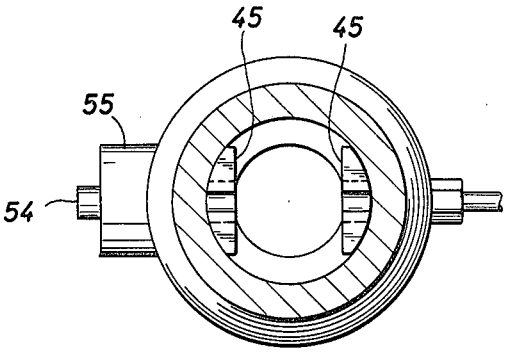
FIG. 5 is a section view along the line 5—5 of FIG. 4 showing the gates in the raised position and in contrast to the extended position of FIG. 3.

The cylindrical housing has an internal polished surface 50. This is a surface adapted to receive the sleeve 30 at least partly thereinto on telescoping movement as shown in FIG. 4. The surface 50 thus enables upward or telescoping movement of the sleeve. When the sleeve moves upwardly as shown in FIG. 4, the gates are rotated. They are forced to rotate as shown in FIG. 4 because there is no clearance for the protruding tabs. This moves both gates to a lateral position, thereby opening the wireline tool trap fully along its axis. This upward movement clears the passage completely of the gates. The upward limit of travel is depicted in FIG. 4, and sets forth the mode in which the tool normally operates when the passage is clear.

Upward movement raises the enlargement 36. The enlargement 36 moves adjacent to an indicator rod 54. The rod 54 is captured within a housing 55. The rod has an enlargement around it which captures a coil spring 56. The spring forces the rod toward the interior of the tool. The tip of the rod supports a sphere or ball 57 which rolls on the surface of the sleeve and up the shoulder toward the enlargement 36. As the enlargement 36 moves upwardly, the rod 54 is forced outwardly to serve as an indicator of the operative state of the wireline tool trap 10.

The retracted position is shown in FIG. 2. This occurs when the sleeve is down where the gates intercept and support the wireline tool when it is above the trap. When the trap 10 is fully opened, the indicator extends as shown in FIG. 4 to provide the contrasting position.

The upper end of the equipment as depicted in FIG. 2 discloses a connective sub 58 which threads to the housing 28. It, in turn, threads to a coupling 59. The coupling latches around an enlargement 60, the enlargement 60 being formed on a connective member 61. The threaded coupling 59 enables easy disconnection of the apparatus.

Operation of the wireline tool trap 10 is hydraulically triggered. By applying hydraulic oil under pressure, either above or below the enlargement 36, the internal sleeve 30 is driven upwardly or downwardly to the desired position. In the down position, the two gates are positioned to catch the wireline tool. Needless to say, it can pass upwardly through them readily as would be achieved if the tool in FIG. 2 were raised on the wireline 15. The gates simply bump to the side. When the tool is above the gates, it is able to rest on them.

While the foregoing is directed to the preferred embodiment, the scope thereof is determined by the claims which follow.

I claim:

1. For use in selectively capturing a wireline supported tool, an apparatus which comprises:

(a) an elongate hollow tubular housing having an axial passage therethrough, said passage being sized to receive a wireline and wireline supported tool therethrough;

(b) a pair of tab supported gate members;

(c) individual pivot mounting means for each of said gate members to enable said gate members to move to a transverse position jointly wherein said pair of gate members extend transversely across said axial passage through said tubular housing;

(d) shoulder means abutting said gate members in the transverse position to secure said gate members in the transverse position and further preventing rotation of said gate members past said transverse position; and (e) means for raising and lowering said gate members within said tubular housing immediately adjacent to a cavity on the interior of said tubular housing wherein wall surface means defining said cavity is constructed and arranged to work against the tabs on said gate members to pivot said gate members from said transverse position to a retracted position clearing the axial passage through said tubular housing.

2. The apparatus of claim 1 including externally visible means operated by said gate raising means to indicate the operating position of said gate members relative to said shoulder means.

3. The apparatus of claim 2 wherein said visible means comprises a movable member positively moved to form the visible indication.

4. The apparatus of claim 1 wherein said gate members comprise a pair of facing semi-circular profiled and pivotally mounted gates deployed oppositely of one another and each is mounted for rotation toward said shoulder means.

5. The apparatus of claim 4 including facing diametric edges on said gate means.

6. The apparatus of claim 5 wherein said gate members in said transverse positions thereof define a gap of preselected size between said gate members on closing toward said shoulder means.

* * * * *